United States Patent [19]

Shenker

[11] Patent Number: 4,823,240

[45] Date of Patent: Apr. 18, 1989

[54] AUDIO-VISUAL ASSEMBLY FOR ARTICLES OF CLOTHING

[76] Inventor: Nathan Shenker, 962 E. 13th St., Brooklyn, N.Y. 11230

[21] Appl. No.: 91,715

[22] Filed: Sep. 1, 1987

[51] Int. Cl.[4] ..... F21L 15/08

[52] U.S. Cl. ..... 362/103; 362/108; 362/253; 362/234; 362/806

[58] Field of Search ..... 362/103, 104, 105, 108, 362/102, 800, 806, 253, 234

[56] References Cited

U.S. PATENT DOCUMENTS

| | | | |
|---|---|---|---|
| 3,043,423 | 7/1962 | Shenker . | |
| 3,549,878 | 12/1970 | Bailey . | |
| 4,164,008 | 8/1979 | Miller et al. . | |
| 4,216,464 | 8/1980 | Terry | 362/103 |
| 4,234,907 | 11/1980 | Daniel . | |
| 4,338,547 | 7/1982 | McCaslin | 362/800 |
| 4,386,550 | 6/1983 | Newsome et al. . | |
| 4,480,293 | 10/1984 | Wells | 362/108 |
| 4,570,206 | 2/1986 | Deutsch | 362/103 |
| 4,602,191 | 7/1986 | Davila | 362/800 |
| 4,709,307 | 11/1987 | Branam | 362/103 |

FOREIGN PATENT DOCUMENTS

| | | | |
|---|---|---|---|
| 2141631 | 2/1982 | Fed. Rep. of Germany | 362/104 |
| 2576165 | 3/1986 | France | 362/103 |
| 2136673 | 9/1984 | United Kingdom | 362/104 |

*Primary Examiner*—Stephen F. Husar
*Assistant Examiner*—Sue Hagarman
*Attorney, Agent, or Firm*—Gottlieb, Rackman and Reisman

[57] ABSTRACT

An audio-visual assembly for garments and a method for affixing the assembly thereto is provided. The assembly consists of light-emitting diodes electrically connected to an audio module so that the diodes blink in synchronism with the rhythm emitted by the audio module. The diodes are placed at least partially along the outside surface of the garment so that they are visible during ordinary wearing of the garment. The audio module is positioned on the inside surface of the garment so that it is not visible during wearing and includes a push-button actuator which is depressed by pressing against the area of the garment under which the actuator is positioned in order to initiate operation of the audio-visual assembly.

20 Claims, 2 Drawing Sheets

AUDIO-VISUAL ASSEMBLY FOR ARTICLES OF CLOTHING

This invention relates to articles of clothing, and more particularly to the use of a batterypowered audio module and synchronized light-emitting diodes affixed to and mounted on shirts and other articles of clothing.

In recent years, the use of light-emitting devices has been introduced in connection with various accessory articles including jewelry, watches and the like. This has been possible because of the miniaturization of electronic circuitry and the reduction in size of light source elements. Particularly, individual light-emitting elements are positioned on the outside of jewelry or watches, and an energizing circuit, which may optionally form part of the jewelry structure itself, is usually placed directly beneath the light-emitting devices or at a location close thereto.

Along with the reduction in size of electronic circuitry, there has been the incorporation of display devices with articles of clothing in order to provide an illuminated garment suitable for wearing. Such garments may utilize a flexible circuit sheet that supports light-emitting devices. The devices protrude through the face of the article of clothing and are therefore visible to the casual observer.

In order to enhance the effect of an illuminated article of clothing, it is possible to modulate the intensity of the light-emitting elements in response to the sound level of musical tones This is achieved by using a battery-powered audio module and synchronized light-emitting diodes such that the diodes flash in synchronism with the sound produced by the audio module The audio module includes a standard circuit board, speaker and battery and is activated by either a light-sensitive switch or a push-button activator.

Although such audio-visual assemblies are known in the art, and have previously been used in connection with articles of clothing in order to enhance the enjoyment of the wearer and to provide both audio and visual displays to the observer, such assemblies are not completely satisfactory.

In all cases, ,the article of clothing, such as a shirt or sweater, are pre-formed with the audio-visual assembly and are not easily removable from the garment without the risk of damage to either the garment itself or to the audio-visual assembly, including the circuitry which controls the operation thereof. As a result, it is not possible to wash or clean the garment since the assembly cannot be easily removed therefrom. Additionally, the material of the garment in the area of the assembly cannot stretch in response to movements of the wearer since the assembly is interconnected to the garment.

Moreover, the electronic circuitry, including the audio module, are often times exposed when wearing the garment, thereby detracting from the aesthetic appeal of the light-emitting elements, which are usually coordinated with the design or drawing printed on the garment.

Accordingly, it is desirable to provide an audio-visual assembly for articles of clothing that is easily detachable and removable therefrom and in which the electronic circuitry is hidden from view.

SUMMARY OF THE INVENTION

Generally speaking, in accordance with the invention, an audio-visual display assembly for an article of clothing is provided. The assembly includes an audio module, which is a small battery-powered electronic device that plays a specific sound sequence, and low-voltage light-emitting diodes of one or more colors that are connected to the audio module. When the audio module is activated, the diodes flash in synchronism with the sound produced by the module. Activation is initiated by a push-button activator, although a light-sensitive switch, which is triggered by transition from dark to light, may be used instead.

In order to removably connect the display assembly to a garment, the audio module is placed along the inside surface of the garment so that the module is not visible during garment wearing. The light-emitting diodes, which are connected in parallel with the module, are inserted within a plurality of openings formed at desired locations along the front of the garment. The diodes are formed with annular flanges which retain the diodes on the outside surface of the garment front so that they are visible during ordinary wearing thereof.

In order to wash or clean the garment, the light-emitting diodes are removed from the garment openings. Consequently, the assembly is no longer affixed to the garment and the garment may be washed or cleaned in a conventional manner. When reattachment of the assembly is desired, the diodes are simply reinserted through the openings formed in the garment and the module repositioned along the inside surface of the garment.

Accordingly, it is an object of the invention to provide an audio-visual display assembly suitable for affixation to an article of clothing.

Still another object of the invention is to provide an audio-visual display assembly which is easily removable from an article of clothing.

Still a further object of the invention is to provide an illuminated article of clothing which can be easily cleaned or washed without damage to the illumination means.

Yet another object of the invention is to provide an audio-visual display assembly for a garment in which the electronic hardware is hidden from view.

Yet a further object of the invention is to provide an illuminated article of clothing which does not restrain movement of the wearer.

Still other objects and advantages of the invention will in part be obvious and will in part be apparent from the following description.

The invention accordingly comprises the several steps and the relation of one or more of such steps with respect to each of the others, and the articles possessing the features, properties and relation of elements, which are exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings in which.

DETAILED DESCRIPTION OF PREFERRED EMBODIMENT

Figure 1:
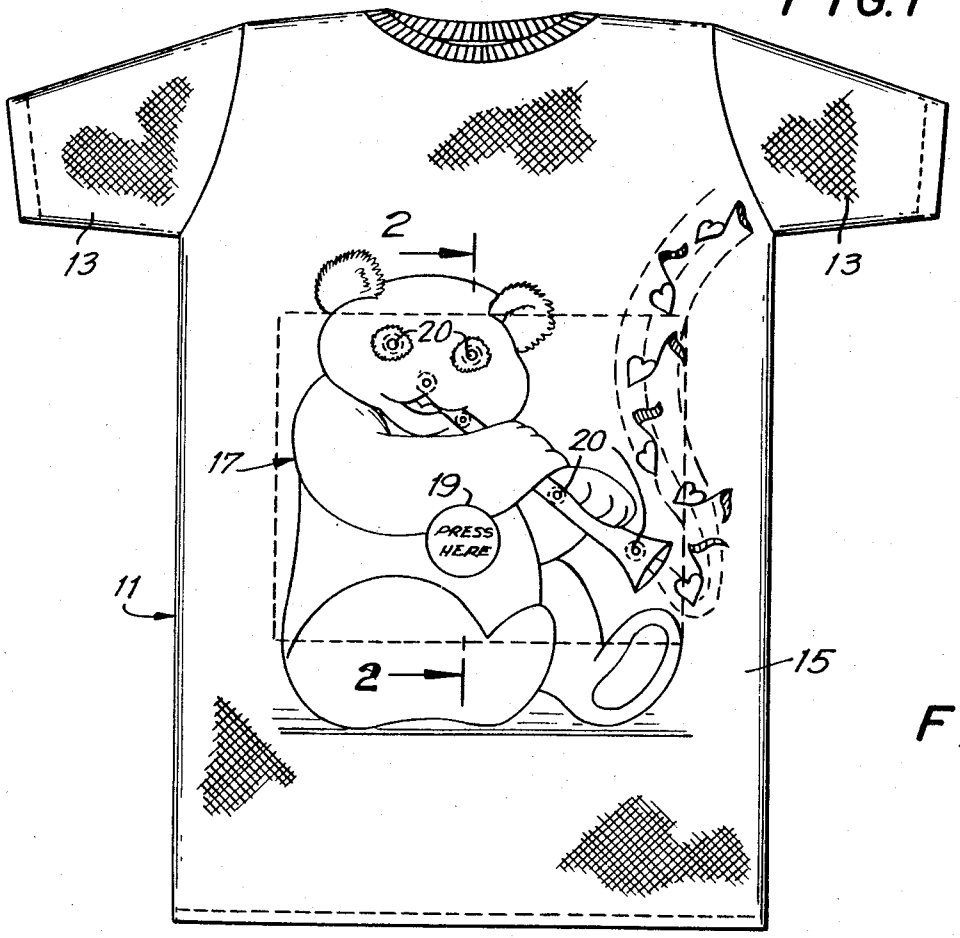
FIG. 1 is a front elevational view of an article of clothing affixed with the audio-visual display assembly of the invention.

Referring first to FIG. 1, a garment 11, such as a shirt, which is suitable for affixation with the audio-visual display assembly of the invention, is illustrated. Garment 11 includes sleeves 13 and a front portion 15. Front portion 15 is provided with an artistic illustration or drawing, which as shown is a Teddy bear picture 17, that includes a centrally positioned circle 19 entitled "press here." Front portion 15 includes a plurality of openings or holes 20 formed therein, which are placed along various locations of picture 17 so that they are in visual harmony therewith. Openings 20 are formed with fabric reinforcing rings 21, which as described hereinafter, enable openings 20 to repeatedly receive the light-emitting diodes of the inventive assembly without damage to garment 11.

Figure 3:
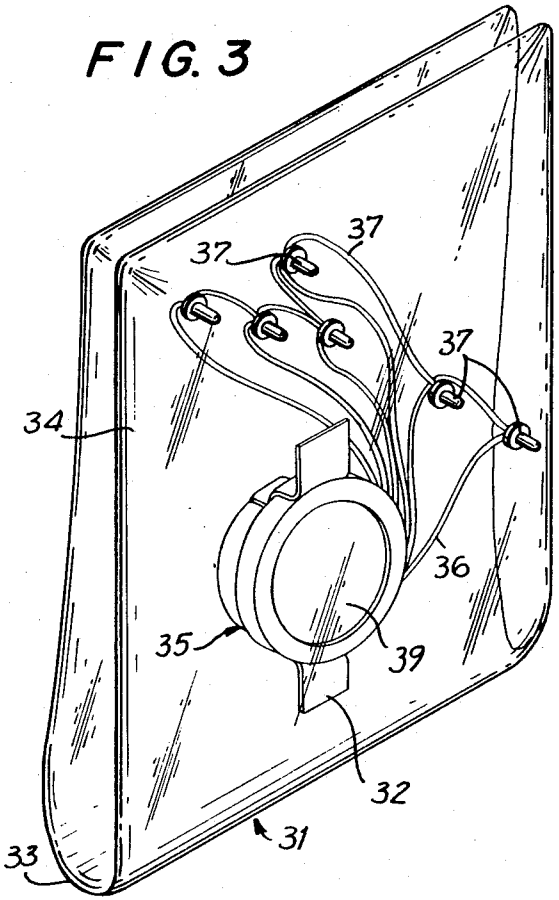
FIG. 3 is a perspective view of the audio-visual display assembly of the invention.

Turning now to FIG. 3, the audio-visual display assembly of the invention, generally designated as 31, is shown. Assembly 31 is housed in a sheet of folded plastic 33 and consists of an audio module 35 mounted therein and a plurality of light-emitting diodes 37. Audio module 35 is attached to front ply 34 of folded plastic 33 by means of tape 32 and houses a push-button activator 39. Diodes 37 are received in and coupled to front ply 34 and are connected electrically in parallel with audio module 35 by means of wires 36, as shown. Diodes 37 flash or light up in synchronism with the specific audio sequence produced by audio module 35 each time push-button activator 39 is pressed. In other words, when audio module 35 is activated, an audio sequence is emitted from the module's speaker (not shown) and diodes 37 light up at the same instance each audio sequence is emitted. When the audio sequence is completed, the lights of diodes 37 no longer flash, and resumption of the process can only occur by reactivation of audio module 35.

Figure 2:
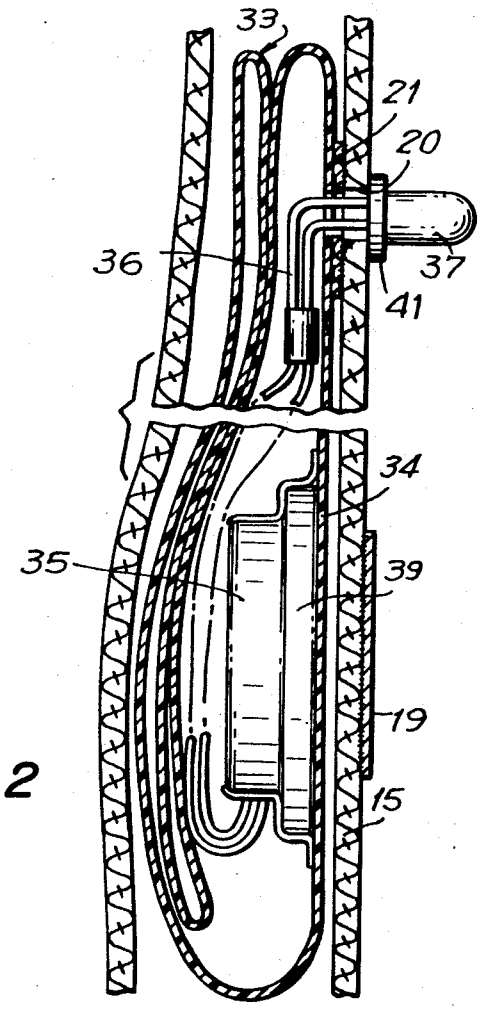
FIG. 2 is a cross-sectional view taken along line 2—2 of FIG. 1.

Reference is now made to FIG. 2, as well as to FIG. 1, which illustrates affixation of audio-visual display assembly 31 to garment 11 in accordance with the invention. As shown, audio-visual assembly 31 is positioned along the inside surface of front portion 15 in order that audio module 35 and wires 36 are hidden from view when garment 11 is worn. Particularly, front ply 34 is carefully placed along the inside of front portion 15 of garment 11 so that push button activator 39 of audio module 35 is directly behind "press here" circle 19.

Light-emitting diodes 37, connected in parallel to module 35 by means of wires 36, are force-fit through openings 20 formed in garment front portion 15. Each diode 37 is integrally formed with an annular flange 41 having a diameter which is slightly larger than the diameter of shirt front openings 20. When passing each diode 37 through its respective opening 20, the material of garment 11 around opening 20 is stretched in order to enlarge sufficiently opening 20 for the insertion of flange 41 therethrough. This is possible since the fabric material around opening 20 includes fabric reinforcing ring 21, which prevents tearing during the insertion of flange 41 of diode 37. Once flange 41 is located on the outside surface of front portion 15, diode 37 is prevented from falling through opening 20 and audio-visual assembly 31 is coupled to garment 11.

In operation, the wearer of garment 11 or a third party observer presses "press here" circle 19 of front portion 15, thereby depressing push-button activator 39 housed in plastic 33 and positioned adjacent front portion 15 of garment 11 directly behind circle 19. This causes the speaker of audio module 35 to emit an audio sequence in synchronization with the lighting up or flashing of diodes 37, as described hereinabove. Accordingly, an illuminated design on garment 11 is observed and a melody or tune projecting from audio module 35 is heard.

In order to detach audio-visual assembly 31 from garment 11, diodes 37 are pulled through openings 20 in a direction toward the inside of front portion 15. Audio-visual assembly 31 is now separated from garment 11, enabling the washing or cleaning of the garment without the risk of damage to the audio-visual assembly. After washing or cleaning is completed, audio-visual assembly 31 is reattached to the garment in a manner in accordance with the described invention.

Figure 4:
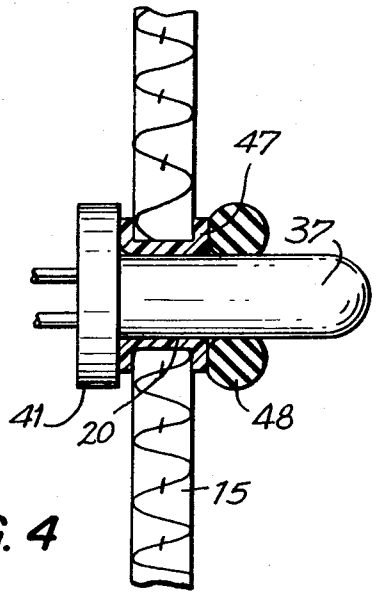
FIG. 4 is an enlarged cross-sectional view of a second embodiment of the audio-visual display assembly of the invention shown removably mounted on a garment.

In a second embodiment of the invention, as shown in FIG. 4, each of openings 20 formed in front portion 15 are reinforced therethrough with a grommet 47. To attach audio-visual assembly 31 to garment 11, diodes 37 are inserted through openings 20. However, rather than forcibly inserting each flange 41 of diodes 37 through openings 20, flanges 41 remain along the inside surface of front portion 15 and O-rings 48 are slipped over the portion of diodes 37 extending forwardly from openings 20 of front portion 15 in order to insure that diodes 37 are retained within opening 20 during wearing of garment 11.

In order to detach the audio-visual assembly from garment 11, O-rings 48 are removed and diodes 37 are pulled out from openings 20, thereby separating audio-visual assembly 31 from garment 11.

The first embodiment of the invention is preferable since grommets 47 may dislodge from openings 20 of garment 11 and O-rings 48 can be lost or misplaced.

With either embodiment, the material of garment 11 can stretch so that the wearer of garment 11 can move freely. This is because assembly 31 is not interconnected with garment 11, but rather is positioned along the inside surface of the front portion 15.

Although the embodiments of the invention are described using a push-button actuator, it is possible to utilize a light-sensitive switch for activating the audio-visual display, which may be triggered, for example, by transition from darkness to light.

Although the invention is described in connection with an assembly which activates an audio display as well as a visual display, it is conceivable that the audio display be eliminated. Accordingly, activation of the push-button actuator would cause illumination of the diodes in a predesigned pattern or sequence, but would not initiate an audio sequence.

It will thus be seen that the objects set forth above, among those made apparent from the preceding description, are efficiently attained and, since certain changes may be made in carrying out the above method and the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A clothing display assembly comprising:

a garment having an inner surface and an outer surface;

at least one means for emitting light removably connected to said garment and positioned at least partially along the outside surface thereof at a location visible during the wearing of said garment;

an audio means for producing a sound sequence removably positioned on the inside surface of said garment at a location not visible during ordinary wearing of said garment; and means for simultaneously activating said at least one light emitting means and said audio means.

2. The clothing display assembly of claim 1, wherein said at least one light-emitting means is electrically connected in parallel with said audio means.

3. The clothing display assembly of claim 1, wherein said activating means is positioned along the inside surface of said garment at a location not visible during ordinary wearing of said garment.

4. The clothing display assembly of claim 1, wherein said activating means comprises a push-button activator.

5. The clothing display assembly of claim 4, wherein the outer surface of said garment includes an area overlying said activator, whereby pressure applied to said overlying area activates said activator.

6. The clothing display assembly of claim 1, wherein said at least one light-emitting means comprises a plurality of light-emitting diodes.

7. The clothing display assembly of claim 6, wherein said garment includes a plurality of openings for removably receiving aids light-emitting means.

8. The clothing display assembly of claim 7, wherein each of said diodes includes an annular flange for retaining each of said received diodes in said openings.

9. The clothing assembly of claim 8, wherein each of said openings are provided with a grommet for receiving said diodes.

10. The clothing display of claim 8, further including an O-ring mounted on each of said diodes for retaining said diodes in said openings.

11. A removably display assembly for a garment having an inner surface and an outer surface comprising:

at least one means for emitting light removably connected to said garment and positioned at least partially along the outside surface thereof at a location visible during wearing of said garment;

an audio means for producing a sound sequence positioned on the inside surface of said garment at a location not visible during ordinary wearing of said garment;

means for simultaneously activating said at least one light emitting means and said audio means.

12. The removable display assembly of claim 11, wherein said at least one light-emitting means is electrically connected in parallel with aid audio means.

13. The removable display assembly of claim 11, wherein said activating means is positioned along the inside surface of said garment at a location not visible during ordinary wearing of said garment.

14. The removable display assembly of claim 13, wherein said activating means comprises a push-button activator.

15. The display assembly of claim 11, wherein said at least one light-emitting means comprises a plurality of light-emitting diodes removably received in a corresponding plurality of openings formed in said garment.

16. A method for removably affixing a garment having an inside and outside surface to a display assembly comprising:

removably connecting at least one light emitting means to said garment along a position at least partially on the outside surface thereof for visibility during wearing of said garment;

removably positioning an audio means on the inside surface of said garment at a location not visible during wearing; and electrically connecting said at least one light emitting means and said audio means to an activating means to enable said at least one light emitting means and said audio means to be simultaneously activated.

17. The method of claim 16, wherein said step of removably connecting said at least one light-emitting means comprises forming at least one opening in said garment and removably receiving said at least one light-emitting means in said at least one opening.

18. The method of claim 17, wherein said receiving step comprises:

inserting said at least one light-emitting means through said at least one opening; and force-fitting a flange means of said at least one light-emitting means through said at least one opening for maintaining reception of said at least one light-emitting means in said at least one opening during wearing of said garment.

19. The method of claim 17, wherein said receiving step comprises:

inserting said at least one light-emitting means through said at least one opening; and coupling a retaining means to said at least one light-emitting means for maintaining reception of said at least one-light-emitting means in said at least one opening during wearing of said garment.

20. A clothing display assembly comprising:

a garment having an inner surface and an outer surface;

at least one means for emitting light removably connected to said garment and positioned at least partially along the outside surface thereof at a location visible during wearing of said garment;

means for activating said at least one light emitting means;

wherein said at least one light emitting means comprises a plurality of light-emitting diodes and wherein said garment includes a plurality of openings for removably receiving said light-emitting diodes; and wherein each of said diodes includes an annular flanges and wherein each of said openings includes a fabric reinforcing means for enabling said diodes to be inserted through said openings without damage to said garment, each of said flanges and said corresponding reinforcing means cooperating to prevent said diodes from falling through said openings after insertion therethrough.

* * * * *